US008992661B2

(12) United States Patent
Jha et al.

(10) Patent No.: US 8,992,661 B2
(45) Date of Patent: Mar. 31, 2015

(54) PRODUCTION OF SPECIALTY ALUMINUM ALLOYS USING PARTITION OF FEED IMPURITIES

(75) Inventors: Gyan Jha, Louisville, KY (US); Frank R. Cannova, Huntington Beach, CA (US); Subodh K. Das, Lexington, KY (US); Barry A. Sadler, Kangaroo Ground (AU)

(73) Assignee: Tri-Arrows Aluminum Inc., Louisville, KY (US)

( * ) Notice: Subject to any disclaimer, the term of this patent is extended or adjusted under 35 U.S.C. 154(b) by 409 days.

(21) Appl. No.: 13/595,589

(22) Filed: Aug. 27, 2012

(65) Prior Publication Data

US 2013/0220823 A1 Aug. 29, 2013

Related U.S. Application Data

(62) Division of application No. 12/220,041, filed on Jul. 21, 2008, now abandoned.

(60) Provisional application No. 60/961,563, filed on Jul. 23, 2007.

(51) Int. Cl.

| | |
|---|---|
| ***C22C 21/06*** | (2006.01) |
| ***C25C 3/06*** | (2006.01) |
| ***C22C 21/00*** | (2006.01) |
| ***C25C 3/36*** | (2006.01) |
| ***C25C 3/26*** | (2006.01) |

(52) U.S. Cl.

CPC . *C25C 3/06* (2013.01); *C22C 21/00* (2013.01); *C22C 21/06* (2013.01); *C25C 3/36* (2013.01); *C25C 3/26* (2013.01)

USPC ..... 75/406; 420/532; 148/552; 205/363; 205/347; 29/527.7

(58) Field of Classification Search

None

See application file for complete search history.

(56) References Cited

U.S. PATENT DOCUMENTS

| | | | | |
|---|---|---|---|---|
| 3,503,184 | A * | 3/1970 | Cook et al. | 95/108 |
| 4,062,696 | A * | 12/1977 | Ducote | 134/1 |
| 4,238,248 | A | 12/1980 | Gyongyos et al. | |
| 6,120,621 | A | 9/2000 | Jin et al. | |
| 2008/0175747 | A1 | 7/2008 | Kajihara et al. | |

* cited by examiner

*Primary Examiner* — Jessee Roe

*Assistant Examiner* — Christopher Kessler

(74) *Attorney, Agent, or Firm* — Dinsmore & Shohl LLP

(57) ABSTRACT

A series of inventions leading to the production of specific aluminum alloys (especially aluminum beverage can sheet product) through novel approach of introducing, selectively partitioning and managing alloying elements. This invention also enables manufacturing practices to enhance the performance characteristics of aluminum alloys produced. The selected elements can be derived from carbon anodes made from calcined petroleum coke with high metallic contents (such as nickel and vanadium). Alloying elements can also be introduced and managed from other raw material such as alumina and bath constituents added during aluminum smelting process. Additionally, cell operating parameters, such as cell temperature, off gas flow rate, aluminum tapping rate and impurity partition characteristics can also be manipulated to produce low cost aluminum alloys and facilitate utilization of high metallic content calcined petroleum coke.

11 Claims, 3 Drawing Sheets

PRODUCTION OF SPECIALTY ALUMINUM ALLOYS USING PARTITION OF FEED IMPURITIES

CROSS REFERENCE TO RELATED APPLICATION

This application is a divisional of U.S. application Ser. No. 12/220,041 filed Jul. 21, 2008, now abandoned, claiming the benefit of U.S. Provisional Application Ser. No. 60/961,563 filed Jul. 23, 2007.

This invention relates to aluminum, and more particularly, it relates to a method of producing alloy rich aluminum in an electrolytic cell.

BACKGROUND OF THE INVENTION

All the production of primary aluminum metal in the world has been and is by the electrolytic dissociation of alumina dissolved in molten bath of cryolite using the Hall-Heroult process. Although the process has become many fold energy efficient and productive since its first commercialization in 1886, the basic process fundamentals have remained unchanged.

Alumina (aluminum oxide) is extracted from alumina bearing ore, bauxite, by a wet chemical process (Bayer process) using caustic soda under high temperature and pressures. Bauxite ore is a complex mixture of aluminum oxide, iron oxide and silicon dioxide (silica) and aluminum refining process dissolves alumina in caustic solution leaving most of the other impurities such as iron oxide, silica and many other oxides of trace elements outside of the solution which is filtered out and discarded as a waste, solution called red mud" (color red derived from the iron oxides). The alumina dissolved in the caustic solution is then precipitated out and calcined to produce metal grade alumina which meets strict composition specification for impurities especially. The impurity control of metal grade alumina is important since virtually all the impurities contained in alumina will end up in aluminum produced in the subsequent aluminum smelting process. It is economically and operationally difficult to produce alumina with varying degree of controlled impurities.

Alumina ($Al_20_3$) is dissolved in molten cryolite ($Na_3AlF6$) and is reduced to aluminum metal by direct current electrolysis in Hall Heroult aluminum smelting cell. The released oxygen rises through the electrolyte and reacts with the sacrificial carbon of the anode, while the molten aluminum settles to the carbon cathode bottom, of the reduction cell. The molten aluminum is periodically removed from the cell bottom by siphoning techniques.

The direct current enters the aluminum smelting cell from sacrificial solid carbon anodes. Burned carbon anodes (called anode butts) are periodically removed from the cell and are replaced by new anodes. Carbon anodes are made from mixing calcined petroleum coke and coal tar pitch, shaping them into "green anodes" which are thermally treated into finished baked anodes to drive out the hydrocarbon volatiles. Most of the calcined petroleum cokes are produced from calcined green coke obtained from the refining of crude oil into carbon residuals followed by extracting green coke in an apparatus called delayed coker. Most of the metallic impurities especially iron, silicon, nickel, vanadium from crude oil are directly transferred to calcined petroleum coke. In particular, the nickel and vanadium contents of calcined petroleum coke keeps increasing due to supply situation from the crude oil. Normally when such anodes are used in smelting cells, most of the nickel and vanadium contents are passed to the aluminum metal produced in a smelting cell. This is not desirable as the higher Ni and V contents produce aluminum metal with much higher nickel and vanadium contents. As it is practiced today, most of the metal impurities from petroleum coke are transferred to the finished aluminum metal.

FIG. 1 shows that vanadium has increased to 270 ppm on average in 2007. The next generation of green cokes products can go as high as 1000 ppm in vanadium content. A similar or worse trend for nickel is projected.

The impurities in both the alumina and carbon will remain in either the aluminum, the cryolite or evaporate with the generated $CO_2$ and mixed gas and particulates from the electrolytic cell. For example $CO_2$ and some of the heavy metal impurities evaporate in the form of relatively volatile fluoride salts. However, the majority of the heavy metallic impurities such as iron, silicon, nickel, and some of the vanadium, etc., precipitate with the primary aluminum and become an impurity in the aluminum.

Due to environmental concerns over fluoride emissions, the exhaust gases from the electrolytic cells are passed through the alumina (primary alumina). This primary alumina traps the majority of heavy metal fluorides and hydrogen fluoride escaping the cell. This dry scrubber alumina called secondary alumina is the primary source of alumina being fed to the electrolytic cell. Consequently, all the heavy metals in the alumina and carbon anodes eventually become part of the primary aluminum.

Tightened regulations on emissions, particularly those of fluoride species, are leading to the development of more efficient systems for cell gas collection and cleaning. With good pot hood collection efficiency, and the dry scrubber recovering and recycling most of the particulate and gaseous fluorides, the operation can be regarded as a closed loop between the cells and the scrubber. As the high particulate collection efficiency also includes those impurities lost to the duct, the recycling of the dry scrubber alumina (secondary or reacted alumina) naturally leads to increased impurity levels in the bath, and thus also in the metal.

Impurity elements unavoidably enter the process stream, mainly with the raw materials. Alumina, anode carbon and the bath material (cryolite and $AlF_3$) are the predominant sources. The impurity levels found in the raw materials vary markedly. Furthermore, operational practices may also contribute on a significant level to the impurity burden, especially for iron and silicon. Although, the impurities can follow several different pathways; the main exit route for several key elements is with the metal. The mechanisms effecting impurity transport in reductions cells are not completely understood, but it is commonly agreed that the transport goes via the electrolyte. Thus, the total impurity burden becomes more important than the particular source of the impurity.

The impurities can be classified based on their behavior in the electrolytic process, including metallic species with higher reduction potential than $Al_20_3$, metallic species with lower reduction potential than $Al_20_3$, water and sulphur, and non-metallic oxides.

The elements in the metallic species with lower reduction potential than $Al_20_3$ are of prime interest in the light of aluminum purity considerations. These elements exhibit different volatility in the electrolyte bath, and can therefore be classified further, such as non-volatile or low volatility impurities, partially volatile impurities and volatile impurities.

SUMMARY OF THE INVENTION

It is an object of the invention to provide a process for producing high purity aluminum and customized or tailored through alloy enrichment.

It is another object of the invention to produce vanadium-enriched aluminum in an electrolytic cell.

It is a further object of the invention to provide a method for operating a series of electrolytic cells for producing aluminum to produce high purity aluminum and metal, e.g., vanadium-enriched aluminum.

It is yet another object of the invention to provide a vanadium-enriched aluminum alloy suitable for forming the same into beverage containers.

It is still yet another object of the invention to provide vanadium-containing aluminum alloys having improved strength properties in the worked condition.

And it is still another object of the invention to provide beverage containers fabricated from vanadium-containing aluminum alloys.

These and other objects will become apparent from a reading of the specification and claims and an inspection of the drawings appended hereto.

Further provided is a method of producing aluminum having relatively high levels of vanadium therein. The method comprises the steps of providing an electrolytic cell for producing aluminum, the cell containing an electrolyte, anode and cathode; adding alumina to said cell, said alumina containing 0.005% to 0.02% vanadium; passing electric current through said cell thereby depositing aluminum at the cathode; operating said method to concentrate said vanadium in the molten aluminum, said vanadium being present in the molten aluminum in the range of 0.01 to 0.25 wt. %; removing said aluminum from said cell; and alloying said aluminum and casting it into a cast product.

Also provided is a method of operating a series of aluminum producing electrolytic cells to produce high purity aluminum and to produce vanadium containing aluminum of lesser purity. The method comprises providing a series of aluminum producing electrolytic cells each having an anode, a cathode and containing anelectrolyte; providing a series of alumina containing hoppers for feeding alumina to said cells; adding alumina from said hoppers to a corresponding cell; collecting fumes from each of said cells (donor cells) to provide collected fumes; dry scrubbing said collected fumes in one of said alumina containing hoppers to concentrate vanadium and impurities on the alumina to be fed to a specific electrolytic cell (receiver cell); operating said cells to produce high purity aluminum and vanadium enriched aluminum in the cell using alumina from the dry scrubber; keeping said high purity aluminum and vanadium enriched aluminum segregated; and casting said aluminum into high purity cast products and vanadium enriched cast products.

DETAILED DESCRIPTION OF PREFERRED EMBODIMENTS

Figure 1:
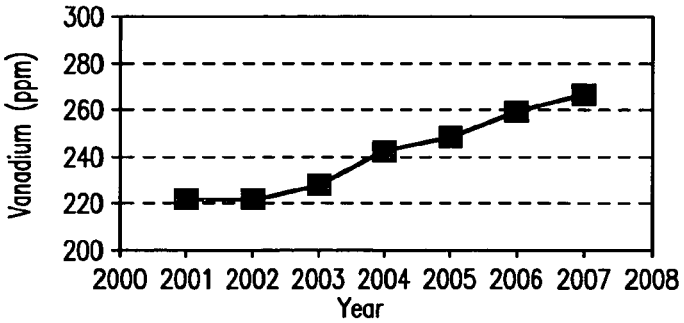
FIG. 1 shows the increase in vanadium content in anode coke.

The common practice for making aluminum alloys is to use commercially available aluminum and mix the desired alloying elements such as Si, Fe, Cu, Mg and Mn to meet chemical specification of final product. An example for producing aluminum alloy beverage can sheet such as AA3104 or AA3004 involves mixing P1020 grade aluminum (0.10% Fe, 0.20% Si) with the required alloying elements in order to attain an average chemistry containing Cu (0.50%), Si (0.5%), Fe (0.50%), Mg (1.0%) and Mn (1.0%).

Normally, while making commercial grade aluminum in Hall-Heroult smelting cells, purest form of cell additions such as alumina, calcined coke and other feed materials are chosen.

This combined practice of producing aluminum alloys using commercial available aluminum and adding alloying elements makes the cost of finished products higher. Furthermore, this practice necessitates the use of raw material of higher quality with lower impurity levels and diminishing supply base.

Thus, it is desired to permit production of different grades of aluminum products using cheaper input raw materials such as lower cost alumina and carbon anodes with higher impurity levels.

The production of the following aluminum products, for example; can be prepared using the present invention:

- 3xxx series aluminum alloys such as 3004 and 3104 used for the production of beverage can sheets
- Aluminum alloys
- Commercial grade p1020 (fe=0.10% and si=0.20%)
- Commercial grade p0202 (fe=0.02% and si=0.02%)
- Commercial grade p2585 (fe=0.25% and si=0.85%)

The invention involves the use of the following two process routes to produce the products mentioned above and enabling the use of high vanadium and nickel petroleum coke.

The impurities can be controlled or partitioned by adjusting the aluminum smelting cell operating parameters, such as:

- Cell temperature
- Partitioning of impurities of off-gas, bath and finished metal, secondary alumina
- Segregation of alumina, bath and coke feeding
- Timing and extent of aluminum tapping
- Cell operating practices In addition, the invention includes managing the composition of the finished aluminum products by manipulating introduction of alloying impurities coming from:

- Calcined petroleum coke
- Alumina
- Aluminum fluoride and other bath constituents
- Flue gas treated alumina
- External sources (tramp impurities, tools)

Further, the invention includes enhancing the performance characteristics of aluminum alloys by managing the variables, such as:

- Chemical composition by varying V content
- Thermal-mechanical process parameters such as rolling and annealing time and temperatures Experimental results show that the partitioning of impurities between the off-gas and the aluminum metal depends on operating mode of the smelting cells. Based on research on impurity distribution in different sized dry scrubber and cell cover alumina particles, primarily motivated by the effort to remove phosphorous due to its detrimental effects on current efficiency, a separate output stream of high impurity alumina fines can be used as a way of reducing the impurity concentrations.

Additionally, another approach, which requires no dumping of impurity laden material, and which recycles the bath material, involves segregation of the alumina feeding streams. This means, that some cells may be run on primary alumina, producing higher quality metal, and the remainder of the cells may be operated on secondary alumina. The cells on secondary alumina may be burdened with increased impurity levels (as compared to the whole plant operating on secondary alumina, i.e., no cells running on primary alumina).

Thus, it will be seen that aluminum purity is mainly influenced by the quality of the raw materials, cell technology, dry scrubbing and partitioning of secondary alumina and operational practices.

The invention includes the following:

Introducing impurities through the raw materials, including alumina, anode carbon and aluminum fluoride; and Operating the smelter as a closed loop circuit with respect to impurity transport, and concentrating the impurities in the metal.

The cell may be operated with no partitioning of the alumina. This may be used as reference point for determining the improvement possible when the operations are changed, and alumina partitioning employed. Further, the cell may be operated with two different levels of alumina partitioning employed with 20 and 40% of the cells • operating on primary alumina.

Figure 2:
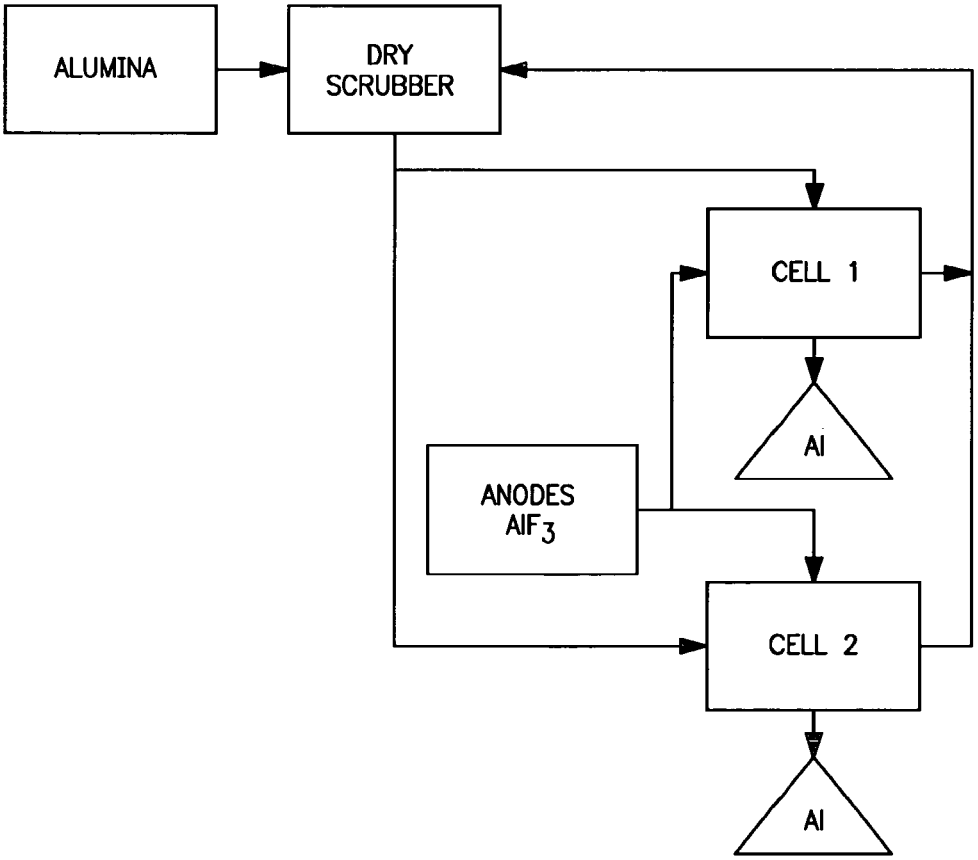
FIG. 2 shows a schematic representation of the Hall-Heroult process with no alumina partitioning.

The flow chart for one suggested scenario is shown in FIG. 2. This scenario is with no partitioning of the alumina. In this example, all the alumina passes through the dry scrubber before being fed into the cell. Consequently, as no other exit streams for the impurities exist than with the metal, all the impurities introduced into the system with the raw materials, end up in the metal.

The impurity concentration in the metal is shown in the table below.

TABLE

Impurity concentration in aluminum for selected elements (no feeding of primary alumina)

| Impurity Element | Concentration ppm(mg/kg) |
|---|---|
| Ti | 71 |
| Fe | 358 |
| Ga | 134 |
| Si | 208 |
| V | 161 |
| Ni | 91 |
| P | 23 |

Figure 4:
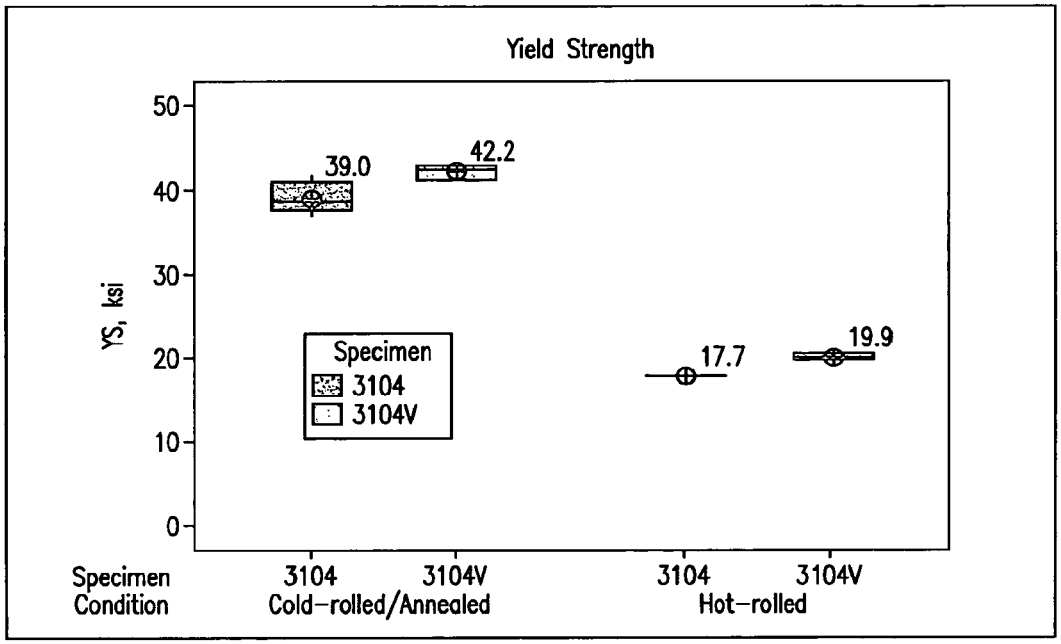
FIG. 4 is a graph showing the strength properties of a vanadium-containing alloy.
Figure 5:
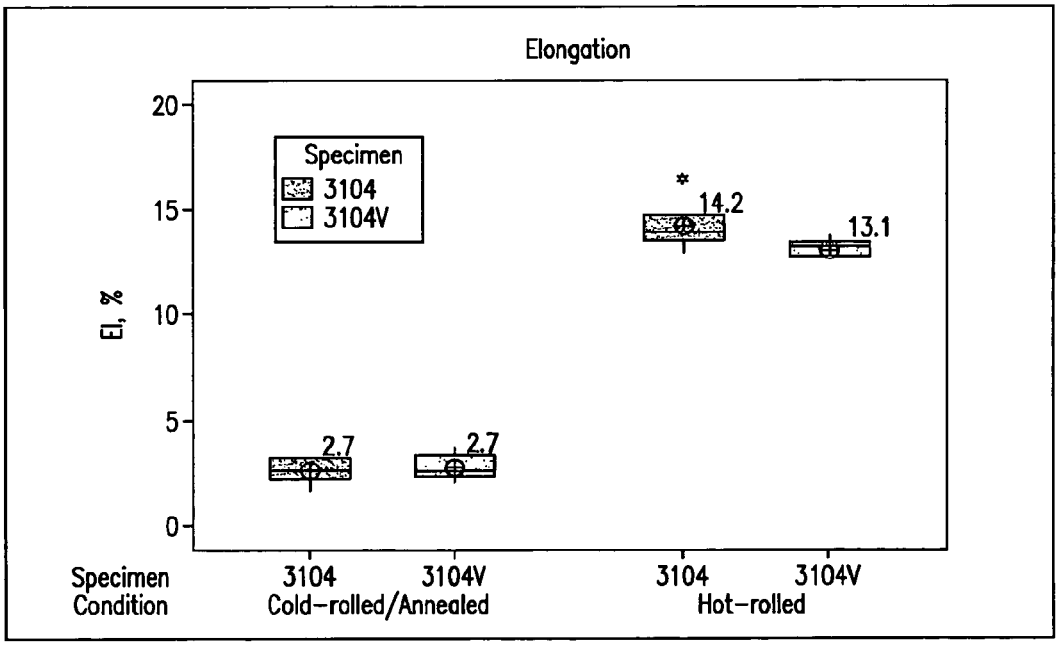
FIG. 5 is a graph showing the elongation properties of a vanadium-containing alloy.

The invention includes chemistry control and thermo-mechanical processes to obtain desired microstructure and mechanical properties. That is, for example, it is possible to cast and roll 0.11% V aluminum beverage can sheet alloys. It should be noted that 0.11% V alloy represents 3 KSI increase of yield strength compared to normal alloy containing only trace amount of vanadium (see FIG. 4). The ductility remains comparable and acceptable (FIG. 5). The alloy with high V represents aluminum production using calcined coke with high V content whereas the alloy with only trace amount of V represents aluminum production using calcined coke with very low V content.

Direct chill (DC) casting trials were run. One run involved standard AA3104 and one involved AA3104 with 0.11% Vanadium addition. The melting was prepared in an induction furnace and degassing done using a porous plug with Argon gas. Each cast produced 2 slabs of 6"×18"×110". The bottom and head of the casting slabs were removed and were further hot rolled at specific temperatures combined with different rolling reduction at each rolling pass. The hot rolled plates were further cold rolled in the following two passes with the gauge of 0.04 and 0.025" respectively. Then the sheets were heated to 204° C. in the infrared in-line heater, followed by final pass with a gauge of—0.015".

The addition of vanadium modified the microstructure of aluminum beverage can sheet alloy. The grain structure was finer in hot rolled and cold rolled sheets of V-modified alloy when compared to the base aluminum alloy. Finer grain structure leads to higher strength of aluminum alloys. The morphology of intermetallic constitutes in both alloys is similar to the commercial can body stock. It appears that vanadium might promote the precipitation of fine dispersoids, which also may be a contributor to the increase of strength.

In another embodiment, the invention includes a method of forming aluminum having relatively high levels of vanadium therein The method comprises' the steps of providing an electrolytic cell for producing aluminum, the cell containing an electrolyte, anode and cathode; adding alumina to said cell, said alumina containing 0.005% to 0.025% vanadium; passing electric current through said cell thereby depositing aluminum at the cathode; operating said method to concentrate said vanadium in the molten aluminum, said vanadium being present in the molten aluminum in the range of 0.01 to 0.25 wt. %; removing said aluminum from said cell; and alloying said aluminum and casting it into a cast product.

Figure 3:
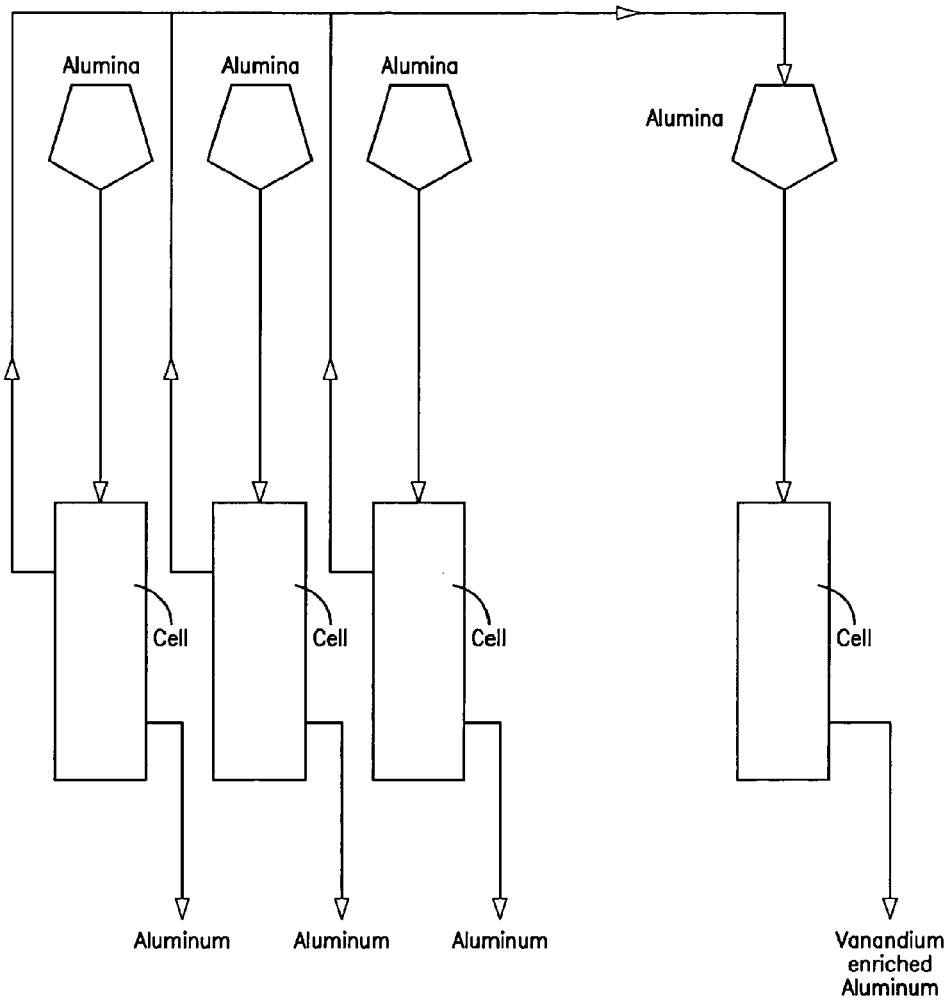
FIG. 3 is a flow diagram showing partitioning of the volatile materials.

In yet another embodiment (see FIG. 3), a series of aluminum product electrolytic cells are operated to produce a method of operating a series of aluminum producing electrolytic cells to produce high purity aluminum and to produce vanadium containing aluminum of lesser purity, the method comprising providing a series of aluminum producing electrolytic cells having an anode, a cathode and containing an electrolyte providing a series of alumina containing hoppers for feeding alumina to said cells; adding alumina from said hoppers to a corresponding cell; collecting fumes from each of said cells to provide collected fumes; dry scrubbing said collected fumes in a reactor to concentrate vanadium and impurities on the alumina to be fed to a specific electrolytic cell; operating said cells to produce high purity aluminum and vanadium enriched aluminum in the cell using alumina from the dry scrubber; keeping said high purity aluminum and vanadium enriched aluminum segregated; and casting said aluminum into high purity cast products and vanadium enriched cast products.

Having described the presently preferred embodiments, it is to be understood that the invention may be otherwise embodied within the scope of the appended claims.

What is claimed is:

1. A method of forming high vanadium aluminum, the method comprising:

a) providing a series of aluminum producing electrolytic cells, the series having at least one donor cell and at least one receiver cell;

b) feeding alumina to the series of aluminum producing electrolytic cells;

c) collecting fumes from at least one donor cell;

d) dry scrubbing the collected fumes in the alumina to be fed to at least one receiver cell; and e) operating the cells to produce vanadium enriched aluminum in at least one receiver cell; wherein the vanadium enriched aluminum comprises 0.01 to 0.25 wt. % vanadium.

2. The method according to claim 1 wherein the alumina fed to at least one donor cell comprises 0.005 to 0.025 wt. % vanadium.

3. The method according to claim 1 wherein an anode in at least one donor cell is made from calcined petroleum coke comprising vanadium at 0.035 to 0.1 ppm.

4. The method according to claim 1 wherein an anode in at least one donor cell is made from calcined petroleum coke comprising nickel at 0.02 to 0.8 ppm.

5. The method according to claim 1 wherein fine particles containing vanadium, iron, phosphorus, and nickel are separated from the alumina fed to at least one receiver cell after dry scrubbing and fed to a specific cell or cells to produce high vanadium aluminum.

6. The method according to claim 1 wherein there is a plurality of donor cells.

7. The method according to claim 1 wherein all the vanadium is introduced through the alumina, the anode, or the electrolyte and is not added as raw elemental V.

8. A method of forming high vanadium aluminum, the method comprising:

a) providing a series of aluminum producing electrolytic cells, the series having a plurality of donor cells and at least one receiver cell;

b) feeding alumina comprising 0.005 to 0.025 wt. % vanadium to the series of aluminum producing electrolytic cells;

c) collecting fumes from the donor cells;

d) dry scrubbing the collected fumes in the alumina to be fed to at least one receiver cell; and e) operating the cells to produce vanadium enriched aluminum in at least one receiver cell; wherein the vanadium enriched aluminum comprises 0.01 to 0.25 wt. % vanadium.

9. The method according to claim 8 wherein an anode in at least one donor cell is made from calcined petroleum coke comprising vanadium at 0.035 to 0.1 ppm.

10. The method according to claim 8 wherein an anode in at least one donor cell is made from calcined petroleum coke comprising nickel at 0.02 to 0.8 ppm.

11. The method according to claim 8 wherein fine particles containing vanadium, iron, phosphorus, and nickel are separated from the alumina fed to at least one receiver cell after dry scrubbing and fed to a specific cell or cells to produce high vanadium aluminum.

* * * * *